US005307743A

United States Patent [19]

Jones

[11] Patent Number: 5,307,743

[45] Date of Patent: May 3, 1994

[54] APPARATUS FOR DESLAGGING A CYCLONE FURNACE

[75] Inventor: Linza J. Jones, Alvarado, Tex.

[73] Assignee: Halliburton Company, Houston, Tex.

[21] Appl. No.: 995,094

[22] Filed: Dec. 22, 1992

Related U.S. Application Data

[62] Division of Ser. No. 707,711, May 30, 1991, Pat. No. 5,196,648.

[51] Int. Cl.[5] ..... F42B 1/02; F42B 3/00; F23B 7/00

[52] U.S. Cl. ..... 102/307; 102/312; 102/332; 165/84; 110/343

[58] Field of Search ..... 102/307, 312, 313, 331, 102/332; 165/84; 110/341, 343

[56] References Cited

U.S. PATENT DOCUMENTS

| | | | |
|---|---|---|---|
| 1,763,407 | 6/1930 | Niesen | 102/24 |
| 2,563,131 | 8/1951 | Old | 266/42 |
| 3,968,723 | 7/1976 | Falterman et al. | 102/23 |
| 4,085,676 | 4/1978 | Calder, Jr. et al. | 102/23 |
| 4,354,433 | 10/1982 | Owen | 102/307 |
| 4,757,764 | 7/1988 | Thureson et al. | 102/312 |
| 4,958,569 | 9/1990 | Mandigo | 102/476 |
| 5,022,329 | 6/1991 | Rackley et al. | 110/234 |
| 5,036,771 | 8/1991 | Alford | 102/307 |
| 5,056,587 | 10/1991 | Jones et al. | 165/1 |
| 5,171,935 | 12/1992 | Michna et al. | 102/275.7 |

*Primary Examiner*—Peter A. Nelson
*Attorney, Agent, or Firm*—Robert A. Kent; Steve Dellett

[57] ABSTRACT

A method and apparatus for deslagging a cyclone furnace in which a series of flexible hollow tubes are inserted into the combustion chamber and the explosive charges in each hollow tube are detonated sequentially. Each of the hollow tubes is biased outwardly against the accumulated slag and ash in the combustion chamber. The hollow tubes may be formed in arcs or rings in planes perpendicular to the longitudinal axis of the combustion chamber, and spacer rings may be positioned between each ring.

8 Claims, 4 Drawing Sheets

APPARATUS FOR DESLAGGING A CYCLONE FURNACE

This application is a division of application Ser. No. 07/707,711, filed May 30, 1991, now U.S. Pat. No. 5,196,648.

BACKGROUND OF THE INVENTION

1. Field of the Invention

This invention relates generally to a method and apparatus for removing the accumulation of combustion ash and slag from the interior of a cyclone furnace and, more particularly, to a method and apparatus for deslagging a cyclone furnace by establishing vibrations in the furnace with controlled, sequential explosions.

2. Description of the Related Art Steam operated generators are used for producing electricity in electric power plants. Steam is produced by heating the external surfaces of panels of tubing. Commonly, heat is provided by the combustion of gas, oil, coal or other hydrocarbon fuels. Combustion of these fuels is incomplete, producing large amounts of waste material.

The controlled combustion of pulverized coal is a common fuel source. However, coal contains numerous impurities that are not efficiently burned and show up as waste material, such as fly ash and slag. This ash and slag collects on the interior surfaces of the cyclone furnaces used to burn the fuel.

In a typical coal fired steam operated generator, several cyclone furnaces are used. Pulverized coal is introduced into the furnace and is ignited in the firebox or combustion chamber. The walls of the cyclone furnace include a number of tubes, and the combustion of the pulverized coal heats water in the tubes to form steam, which is then introduced to a steam turbine.

As discussed above, incomplete combustion of coal produces ash and slag that accumulates in the cyclone furnace. As molten fuel cools, the ash and slag accumulates on the interior surfaces of the combustion chamber. Although it is possible to limit the accumulation of ash and slag by using coal with a heavy pig iron content, environmental concerns make this type of coal undesirable, in many instances, because of its heavy metal content. With other types of coal, the impurities, including dirt and clay, result in large amounts of ash and slag, and these impurities collect on the bottom and sides of the cyclone furnace.

Typically, a steam-operated generator will have as many as 12 to 16 cyclone furnace units. A typical cyclone furnace 10 is shown in FIG. 1. The fire box or combustion chamber 20 of the furnace has a diameter anywhere from approximately 4 feet to 12 feet. In that combustion chamber, there are generally included at least two air inlets, as well as gas inlets, oil inlets, coal inlets, etc. to enable the input of fuel. The pulverized coal and other fuel swirls around during the combustion process in the combustion chamber. Ideally, molten slag exits the combustion chamber by the slag tap hole 23 shown in FIG. 1 and collects in a slag tank for disposal. However, when there are heavy accumulations of ash and slag due to impurities in the coal, there is a collected residue of ash and slag at the bottom of the furnace.

The slag and ash accumulated in the cyclone furnace may be as thick as 12 to 18 inches at the bottom of the combustion chamber, and approximately 2 inches thick at the top and sides. As shown, the fire box or combustion chamber is generally a cylindrical shaped chamber.

The slag or ash that accumulates is very smooth, dense and hard.

As shown in FIG. 2, tubes around the combustion chamber of the cyclone furnace are used to heat water that is then delivered to a steam turbine. The ash and slag buildup in the combustion chamber reduces the overall efficiency of the generator by requiring additional combustion and fuel to properly heat the water within the tubes. In fact, when the slag buildup has occurred, the thermal efficiency of the plant is reduced substantially.

In the past, it is a common practice to periodically clean out the ash and slag from the combustion chamber of cyclone furnaces. This cleaning process normally involves extensive washing with a high pressure water solution, commonly referred to as hydroblasting. Hydroblasting involves inherent problems such as requiring a complete shutdown of the facility for approximately the 12 to 24 hours needed to hydroblast out several cubic yards of accumulated slag and ash. With the typical number of 12 to 16 cyclone furnace units in a plant, well over a million gallons of water are needed to hydroblast out the accumulated slag and ash. This time to hydroblast out the buildup results in lost revenue to the plant because of the down time. The combination of water and ash produces a concrete like material which, if allowed to dry, would harden like concrete and further exacerbate the cleanup problem. In addition, a hydroblasting operation requires the use of expensive wet ash handling equipment, as well as the extensive manpower required to operate it.

An additional byproduct of a hydroblasting operation is the production of sulphuric acid. The water combines with the sulphur oxide in the fly ash, particularly with sulphur laden coal, to produce an acid that is highly corrosive. Thus, immediate attention must be given to the dilution or removal of the sulphur acid to prevent undesirable corrosion and repair of the facility.

The present invention is directed to overcoming one or more of the problems set forth above.

SUMMARY OF THE INVENTION

The present invention provides a method and apparatus for removing slag and accumulated ash from the combustion chamber of a cyclone furnace in a steam power plant. This method involves placing explosive in several flexible hollow tubes inside the combustion chamber on the surface of the slag, at locations which intersect planes perpendicular to the axis of the cylindrical fire box or combustion chamber. The flexible tubes are biased against the slag. Spacers are placed at a specified distance between each flexible hollow tube. The tubes are detonated to jar the accumulated slag and ash from the combustion chamber. Then, the dry ash and slag is removed by a dry method.

Accordingly, it is an object of the present invention to provide a method and apparatus for removing slag and ash from the combustion chamber of a cyclone furnace.

DETAILED DESCRIPTION OF THE PREFERRED EMBODIMENT

Figure 1:
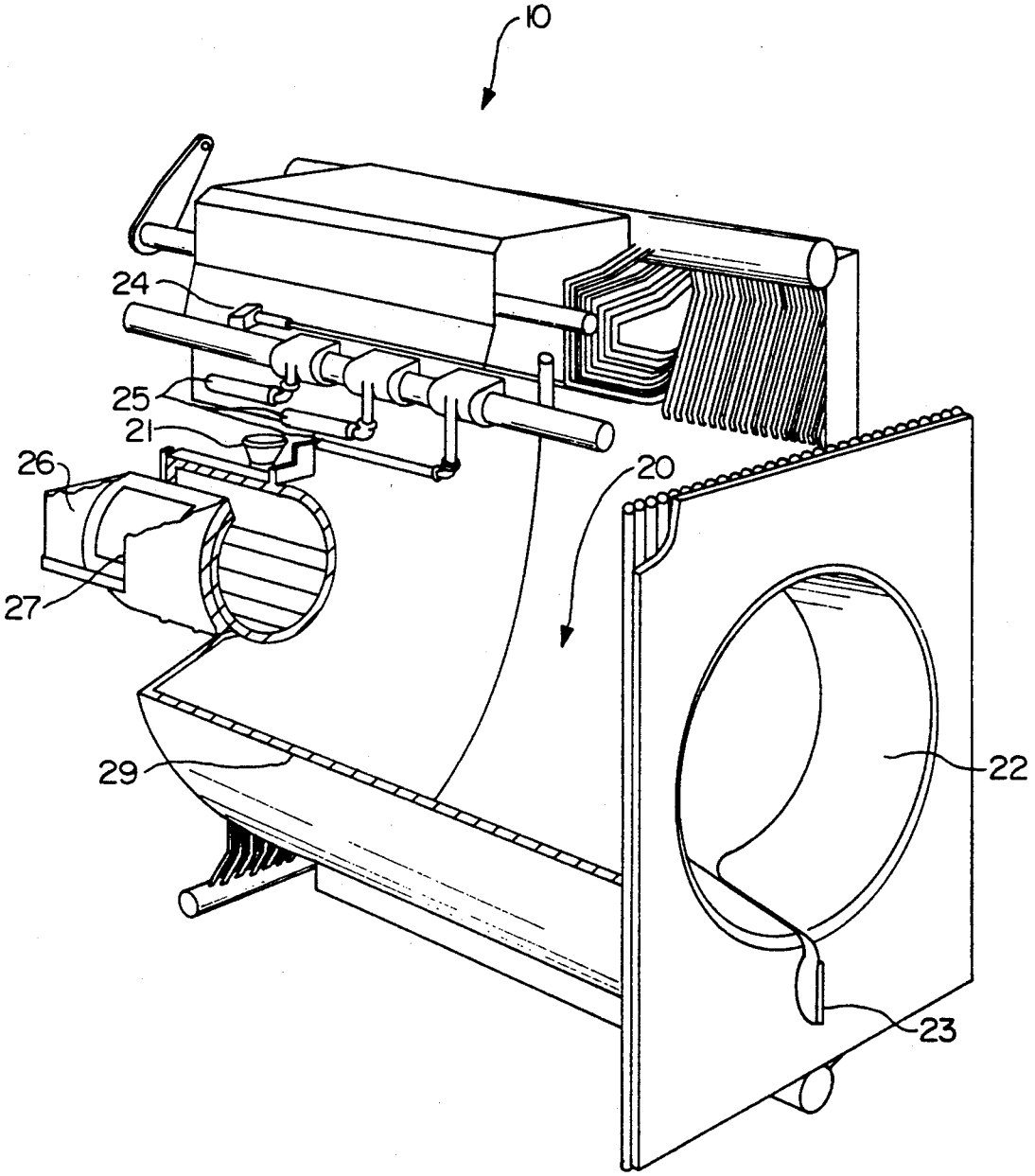
FIG. 1 illustrates a cross-sectional view of a typical cyclone furnace.

In FIG. 1 a typical cyclone furnace is illustrated. The cyclone furnace 10 includes a fire box or combustion chamber 20 which is the part of the furnace to which this invention is primarily directed. Into that combustion chamber coal and other materials are introduced, along with air to obtain proper combustion. The fuel swirls around to heat water in tubes at the outer circumference of the chamber. However, there results an accumulation of molten slag and ash that hardens over a period of time. The amount of hardened ash and slag depends on the quality of the coal.

As shown in FIG. 1, the combustion chamber 20 is a cylindrical cavity within the cyclone furnace, although other shapes of combustion chambers may be effectively cleaned with the present invention. The combustion chamber or fire box includes a series of tubes 29 in its walls, through which water circulates and is heated before it is introduced to a steam turbine.

Pulverized coal is introduced into the cyclone furnace through coal inlet 21. Also shown in FIG. 1 are gas inlets 25 and oil inlet 24. Air is introduced through primary air inlet 27 and tertiary air inlet 26. Adjacent the bottom surface of the re-entrant throat 22 is the slag tap hole 23. Ideally, molten slag exits the combustion chamber via the slag tap hole and then to a slag tank (not shown). However, as the slag and ash accumulates and hardens at the bottom of the combustion chamber, as well as the side and top surfaces, the slag tap hole does not completely remove the slag and ash.

The cyclone furnace shown in FIG. 1 is manufactured by the Babcock and Wilcox Company. This is an example of a cyclone furnace for use with the present invention, but is not intended to show the only type of combustion chamber for which the present invention is intended.

Figure 2:
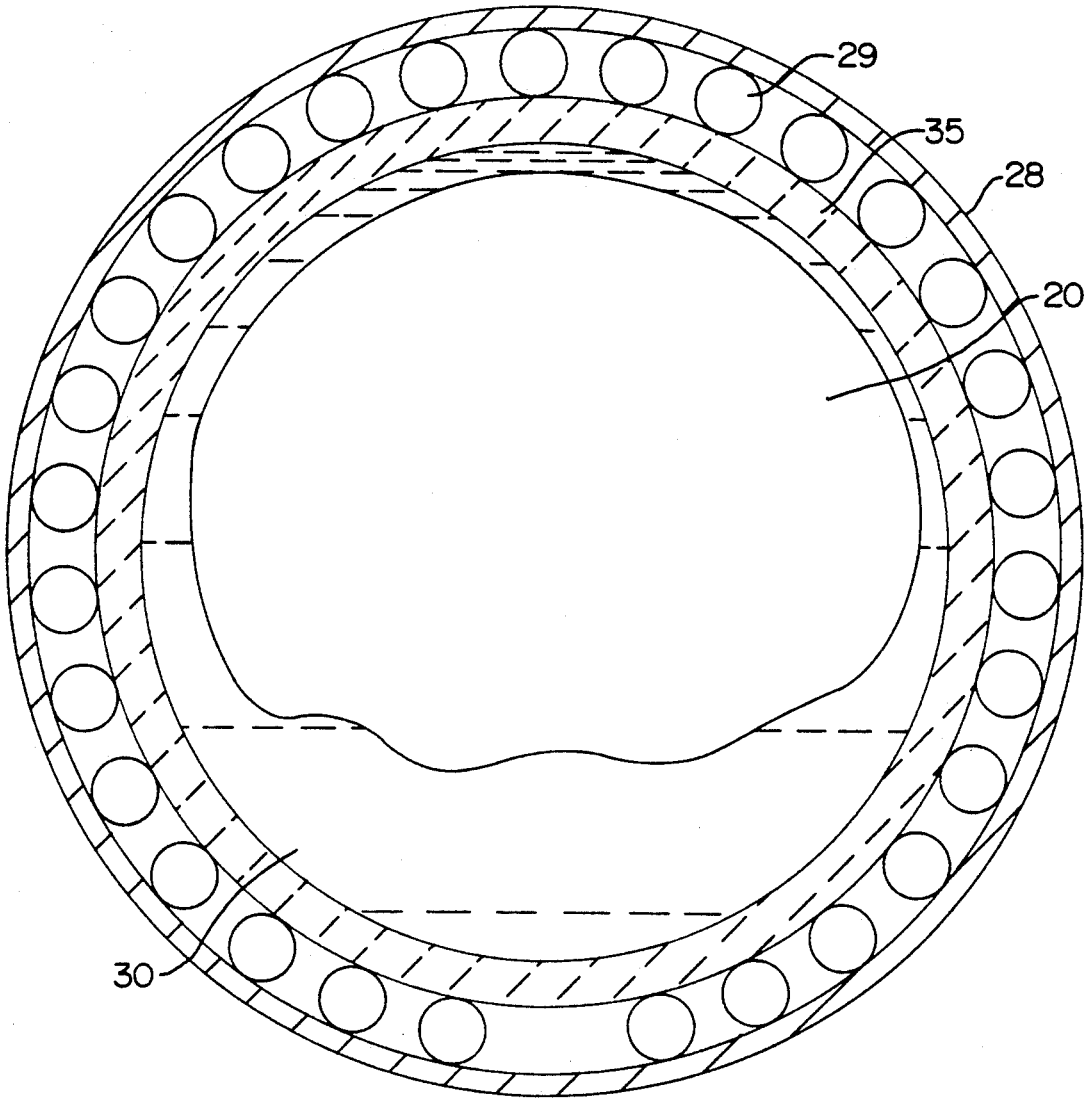
FIG. 2 illustrates a cross-sectional view of a fire box or combustion chamber of a cyclone furnace having ash and slag buildup.

Now referring to FIG. 2, an interior cross-section of the combustion chamber 20 or fire box is shown. The combustion chamber is enclosed within an outer shell 28 and a refractory coating 35. Between the refractory coating 35 and the outer shell 28 are a series of tubes for circulating water which is then introduced into a steam turbine. The water is heated by the combustion of pulverized coal.

Still referring to FIG. 2, the accumulation of slag and ash is shown by reference numeral 30. This slag and ash is thicker at the bottom of the furnace than at the top or sides. For example, it is typical to have 12 to 18 inches of slag and ash at the bottom of a furnace. In contrast, it is typical for the top surface of the combustion chamber to have two inches of slag and ash. The slag and ash buildup may vary in thickness from approximately 1 mm to 300 mm. It is this slag and ash buildup that the present invention removes.

The present invention involves placing an explosive in a series of flexible hollow tubes on the surface of the slag, at locations which intersect planes perpendicular to the axis of the combustion chamber. The invention does not require any attachments to the furnace because the flexible rings are biased against the interior surfaces of the cyclone furnace. In the present invention, flexible tubing that is bent will be biased outwardly. To prevent movement of the tubes upon detonation, spacers are placed at a specified distance between each tube.

Figure 3:
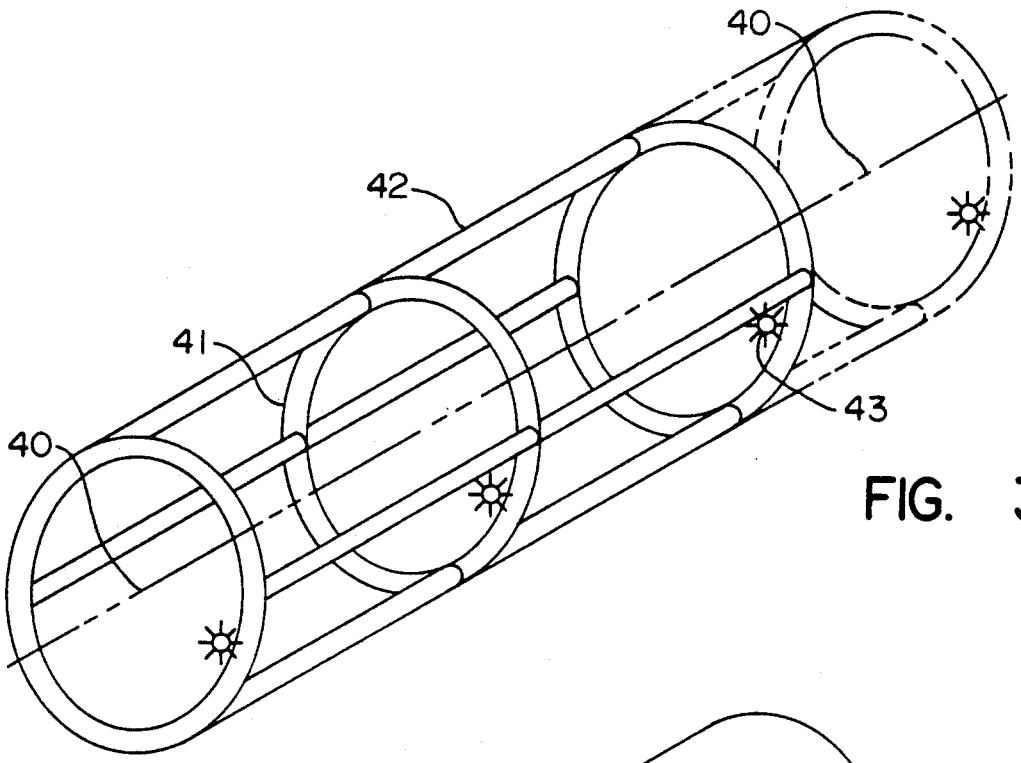
FIG. 3 illustrates a side view of a configuration of detonating cords placed in flexible tubes which are then placed in the cyclone furnace at predetermined locations.

As shown in FIG. 3, in the present invention each of the hollow tubes are formed into a 360° ring 41. The 360° ring is preferred, although the present invention also contemplates forming an arc of less than 360°. These arcs or rings 41 are positioned at planes perpendicular to the cylindrical axis 40 of the combustion chamber. A flexible linear charge or detonating cord is inserted within each of the rings. The arcs or rings 41 are made of a flexible tubing such as PVC.

With the present invention, slag fragmentation is achieved by detonating the explosive within each of the flexible rings after the rings are positioned inside the cyclone furnace. The diameter of each arc or ring and the wall thickness of the tubing will determine the amount of explosive to be used inside each ring. In addition, the thickness of the slag helps determine the type of explosive used, the grain loading of the detonating cord, and whether the application requires use of a flexible linear shaped charge. the flexible linear shaped charge will be discussed below.

Also shown in FIG. 3 are spacer tubes 42. The spacer tubes 42 are used to prevent axial movement of the flexible 360° rings upon detonation and to help ensure that the explosive impact is directed radially outwardly from the rings against the slag and ash in the combustion chamber. The spacer tubes 42 prevent the rings 41 from being blown out the cylindrical axis 40 of the combustion chamber.

Initiation of the slag fracturing is accomplished by timed, sequential detonation, to prevent overpressure or damage to the inside of the furnace. Preferably, fragmentation of the slag is sequenced so that each arc or ring 41 detonates in a clockwise manner, although a counter-clockwise detonation also may be used. Each arc or ring 41 is detonated sequentially at delay locations 43.

Figure 4:
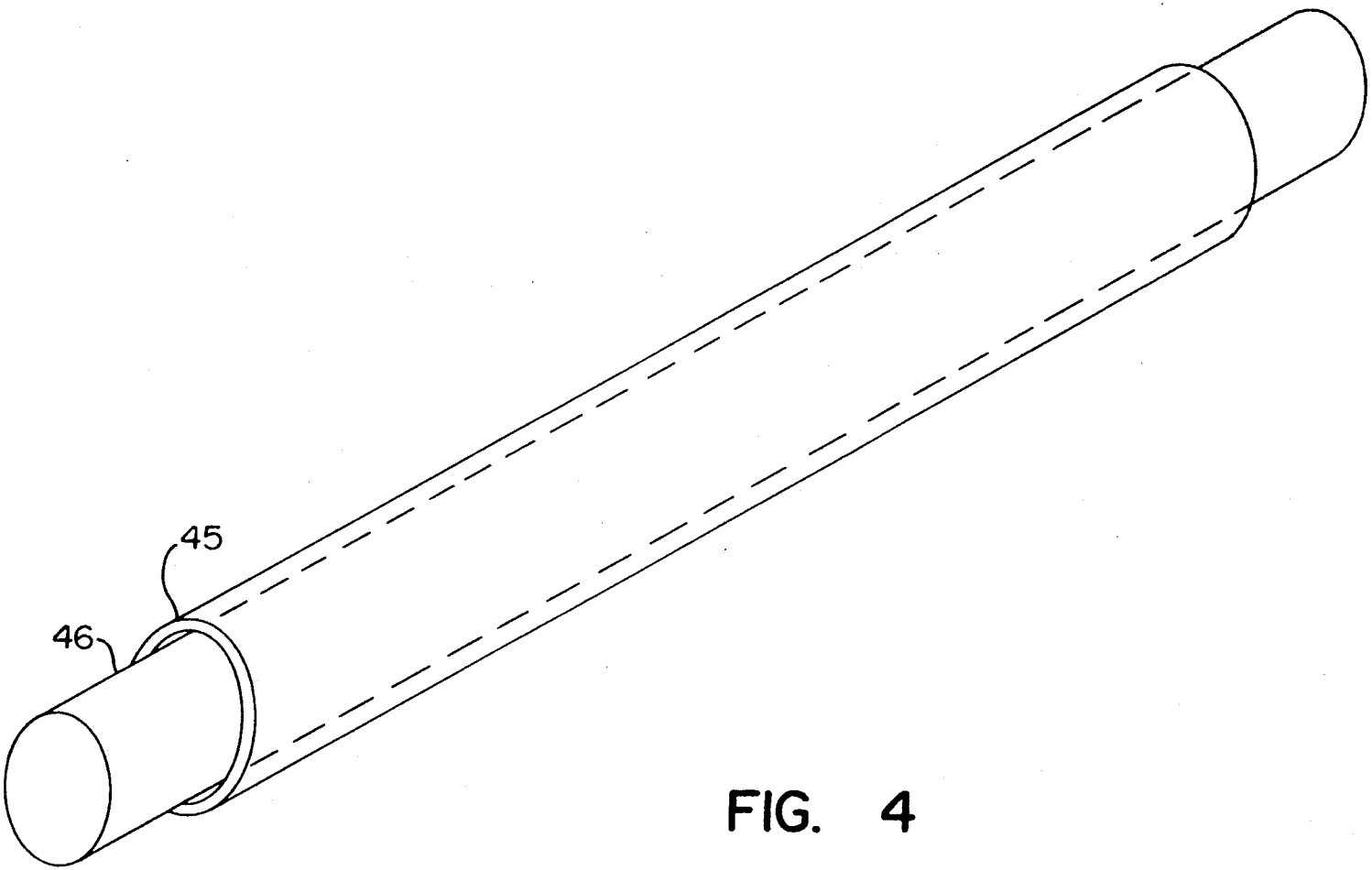
FIG. 4 is a side view of a detonating cord within a flexible tube.

Shown in FIG. 4 is a cross section of a piece of flexible tubing 45 with a detonating cord 46 inserted therein. For slag having a thickness from 1 mm to 80 mm, a PRIMACORD TM detonating cord is preferred. However, in the area where the slag is approximately 80 mm to 450 mm in thickness, a flexible linear charge also may be used. The linear shaped charge is positioned parallel to the cylindrical axis of the furnace.

Figure 5:
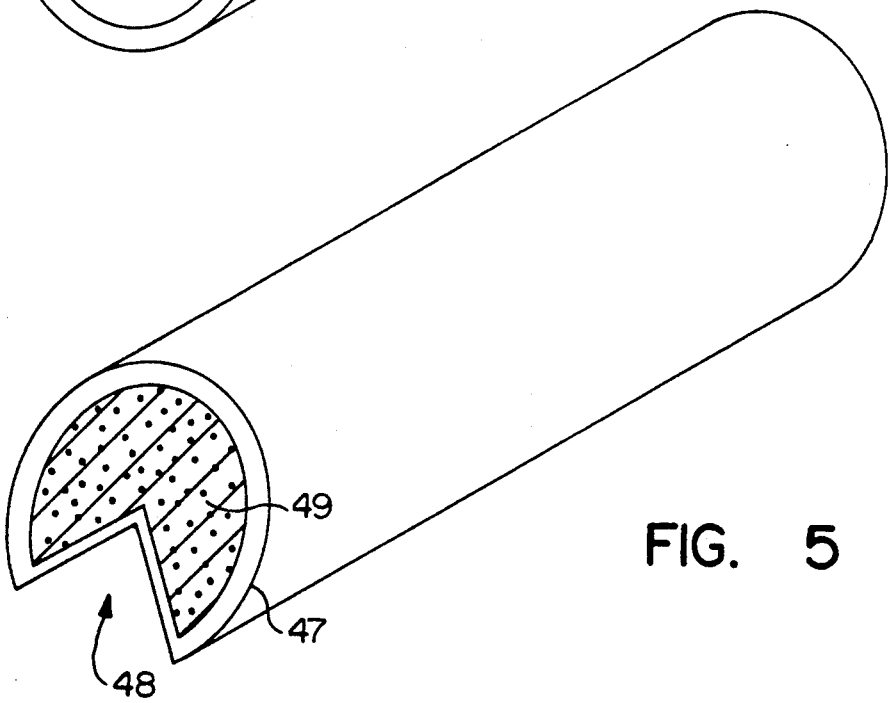
FIG. 5 is a side view of a flexible linear shaped charge for use in the present invention.

The linear shaped charge, depicted in FIG. 5, involves a cavity 48 in one side of the tubing, so that the explosive energy may be directed in one direction, typically in the direction of the bottom surface of the combustion chamber where the slag and ash is thickest. Thus, the tubing 47 for the linear shaped charge has a cavity 48 which results in the explosive force from explosive 49 being directed downwardly against the thickest portion of the accumulated slag.

The linear shaped charge is preferably located at approximately the six o'clock position in the combustion chamber, i.e., at the bottom of the combustion chamber of the furnace. However, the linear shaped charge also may be positioned at another location where a thick region of slag has accumulated. Therefore, the linear shaped charge focuses the explosive energy towards the thickest slag accumulation at the bottom of the furnace. A series of linear shaped charges may be used, each having a defined length and each length detonated in sequence. The explosive in the linear shaped charge is typically RDX powder instead of PRIMACORD TM.

For the flexible 360° rings 41, it is preferred that PRIMACORD TM be used. The PRIMACORD TM detonating cord is manufactured by the Ensign-Bickford Company. The PRIMACORD TM detonating cord has as its primary ingredient pentaerythritol tetranitrate ("PET"). The PRIMACORD TM or other explosive may be inserted fully into the 360° ring, or fully inserted into an arc less than 360°. Or, it may be inserted only partially into the hollow tube so that it does not complete the arc or ring.

The PRIMACORD TM typically comes in large rolls, which then may be cut and inserted into the hollow tubes. The hollow tubes are individually sized for each cyclone furnace. Preferably, the tubing used to form the rings is a PVC tubing with a thickness anywhere from 30/1000 to 50/1000 inches. Preferably, the tubing should have an inner diameter of 2/10 to 3/10 inches, so as to accommodate the PRIMACORD TM detonating cord. The wall thickness and the diameter of the tubing, however, may be varied, although the tubing should be sufficiently flexible to be positioned within and biased outwardly the combustion chamber.

Initiation of the detonation may be instantaneous or delayed, depending on the thickness of the ash and slag. The thickness of ash and slag further determines the grain load to be used. In addition, the distance between each arc or ring 41 depends on the quantity of ash and slag to be removed.

The detonators are associated with each ring 41. The detonators are preferably a non-electric type (such as any of the commercially available detonators, including the Nonel Detonator manufactured by Ensign-Bickford), but electric detonators also may be used in the present invention. The detonators may be programmable to any of a wide variety of delay times.

After fragmentation of the slag, removal is by a dry method. In other words, the fragmented slag and ash may be vacuumed out of the furnace.

One advantage of the present invention is that no attachment means are required to attach the explosive devices to the cyclone furnace. No attachment means are required because the arcs or rings are biased outwardly (or compressed) against the interior walls of the fire box 20, like expanding rings.

In accordance with the present invention, the sequence of operation is as follows. First, several flexible sections of PVC tubing are loaded with PRIMACORD TM. Second, the tubing is bent into arcs or rings and inserted at planes perpendicular to the axis of the cyclone furnace, with axial spacers between each ring. Third, each arc or ring is detonated in sequence so that the slag and ash falls to the bottom of the cyclone furnace. Typically, in this third step slag and ash is fragmented in an arc extending from about seven o'clock to about five o'clock. Fourth, a flexible linear shaped charge may be used for slag remaining on the bottom surface. This linear shaped charge is positioned parallel to the cylindrical axis of the cyclone furnace. In this step, the linear shaped charge is detonated so that the explosive impact is directed downwardly against the thickest portion of the slag. Fifth, after the linear shaped charge is detonated, fragmented ash and slag is removed by a dry process.

Alternatively, fragmented slag and ash may be removed by a dry process before the linear shaped charge is used at the bottom of the cyclone furnace.

Although variations in the embodiments of the present invention may not each realize all the advantages of the invention certain features may become more important than others in various applications of the apparatus and method. The invention, accordingly, should be understood to be limited only by the scope of the appended claims.

I claim:

1. An apparatus for removing accumulated slag from the interior surfaces of a combustion chamber, comprising:

(a) a plurality of flexible hollow tubes, each hollow tube positionable at a preselected position in a plane perpendicular to the longitudinal axis of the combustion chamber;

(b) explosive material inserted into each of the hollow tubes;

(c) spacer means positionable along the longitudinal axis of the combustion chamber between each of the hollow tubes; and (d) detonating means connected to the explosive material.

2. The apparatus of claim 1, wherein each hollow tube is biased outwardly against the interior surface of the combustion chamber.

3. The apparatus of claim 1, wherein the combustion chamber is cylindrical, and each hollow tube forms an arc in a plane perpendicular to the longitudinal axis of the combustion chamber.

4. The apparatus of claim 1, wherein each hollow tube forms a ring of substantially 360° which is biased outwardly against the slag on the interior surface of the combustion chamber.

5. The apparatus of claim 1, wherein each hollow tube is made of PVC tubing.

6. The apparatus of claim 1, wherein the explosive material is PRIMACORD TM detonating cord.

7. The apparatus of claim 1, further comprising a linear shaped charge for directing explosive force in a predetermined direction.

8. The apparatus of claim 1, wherein the detonating means sequentially detonates the explosive material in each of the hollow tubes.

* * * * *